United States Patent [19]

Moss

[11] Patent Number: 4,632,389

[45] Date of Patent: Dec. 30, 1986

[54] SPORT AND HEALTH ACCESSORIES WEIGHT SYSTEM

[76] Inventor: Ernest Moss, 157-16 13th Ave., Beechhurst, N.Y. 11357

[21] Appl. No.: 639,492

[22] Filed: Aug. 10, 1984

[51] Int. Cl.[4] ..... A63B 21/12

[52] U.S. Cl. ..... 272/119; 128/DIG. 15; 273/DIG. 30

[58] Field of Search ..... 272/119, 93; 128/403, 128/DIG. 15; 2/170; 446/85; 273/DIG. 30

[56] References Cited

U.S. PATENT DOCUMENTS

| | | | |
|---|---|---|---|
| 3,278,184 | 10/1966 | Rosenbaum . | |
| 3,334,898 | 8/1967 | McCrory et al. . | |
| 3,374,636 | 3/1968 | Mason . | |
| 4,195,833 | 4/1980 | Svendsen | 272/119 X |
| 4,239,211 | 12/1980 | Wilkerson | 272/119 |
| 4,247,097 | 1/1981 | Schwartz | 272/119 |
| 4,247,101 | 1/1981 | Gallmeter | 272/119 X |
| 4,382,302 | 5/1983 | Watson | 272/119 X |
| 4,425,917 | 1/1984 | Kuznetz | 128/403 |
| 4,441,707 | 4/1984 | Bosch | 272/119 |

FOREIGN PATENT DOCUMENTS

| | | | |
|---|---|---|---|
| 3238894 | 4/1984 | Fed. Rep. of Germany | 446/85 |
| 1300206 | 6/1962 | France | 446/85 |

OTHER PUBLICATIONS

Triangle Band Weight System brochure.

*Primary Examiner*—Richard J. Apley
*Assistant Examiner*—Robert W. Bahr

[57] ABSTRACT

A weighted device which is worn about the body and appendages for improving an individual's physical fitness. The weighted device includes a band shaped configuration constructed of a weight means encased between layers of durable material with one part of hook loop fastener attached along the top surface, and one part of hook loop fastener attached along the bottom surface of said weight device belt. This unique construction not only allows for form fitting and simplified closure of the belt, but also allows one weight belt to be securely attached onto another weight belt allowing for customized weight selection and simplified detachment. Individual weights with hook and loop fasteners attached on the top and bottom surfaces and a clip for mounting said weight devices are also a preferred embodiment of the present invention.

6 Claims, 8 Drawing Figures

FIG. 1
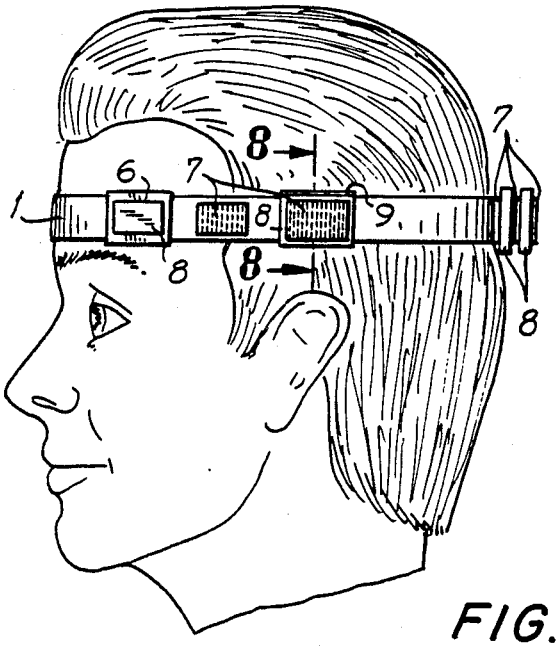
FIG. 2
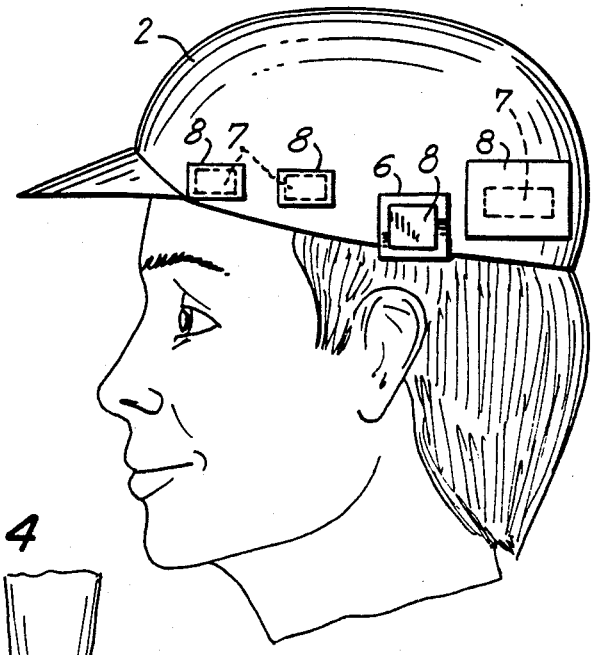
FIG. 4
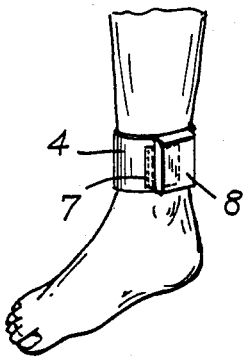
FIG. 3
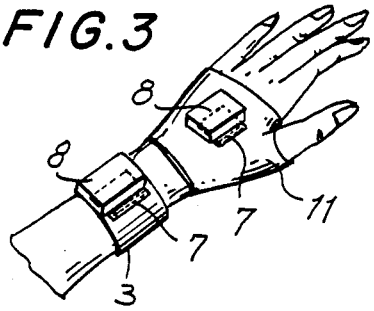
FIG. 6
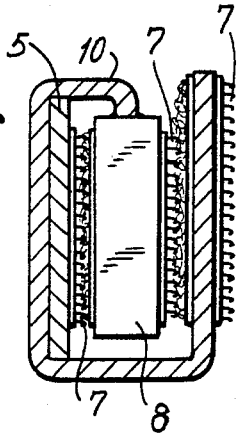
FIG. 5
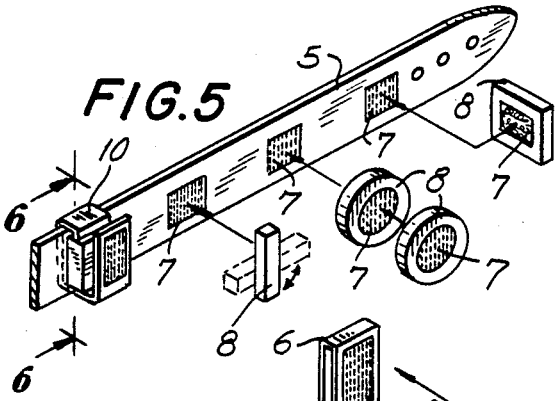
FIG. 7
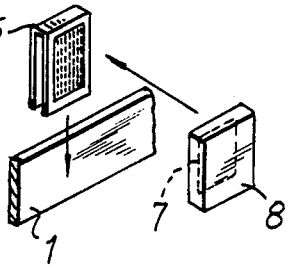
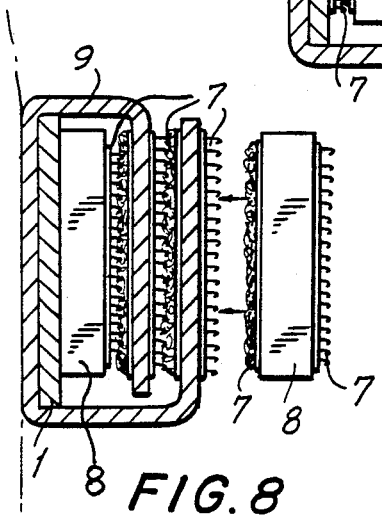
FIG. 8

SPORT AND HEALTH ACCESSORIES WEIGHT SYSTEM

BACKGROUND OF THE INVENTION

The instant invention relates generally to accessories and more specifically to an accessory device made for attachment to various types of apparel and other objects.

Numerous devices have been provided in prior art as weight systems. For example U.S. Pat. Nos. numbered 4,239,211; 3,374,636; 3,334,898; and 3,278,184 all are illustrative of such prior art. While these units may be suitable for the particular purpose for which they address, they would not be suitable for the purpose of the present invention as heretofore described.

Prior known devices are manufactured from designs that result in rigid, bulky, uncomfortable and limited total weight, weight systems. The materials used have little or no stretch capability in the encircling portion of the devices. Because of these design and material characteristics, these devices do not conform completely to the contours of that part of the body they are encircling. They therefore have to be tightly strapped or laced to prevent shifting and slipping of the weights or the entire device, causing discomfort, and yet they still shift and slide during exercise and therapy motions. Especially when the person is sweating or wet.

The materials used to not allow air penetration or circulation to the part of the body they encircle and in fact, they promote sweating and discomfort under the devices, next to the body. This adds to the shifting and slipping characteristics of these devices.

These devices must also be fastened at the smallest diameter part of the extremeties they encircle, i.e., the ankle and the wrist, causing discomfort and irritation to the ankle and wrist bone, to resist sliding up and down of the device during movement of the arms and legs.

In the past, the configurations of variable weights on a weight system were limited due to the inherent size and weight limitations of the pocket design and pocket dimensions on the weight devices. These configurations were limited to lead shot, fixed dimension slug-weights or bulky straps with additional pockets for fixed size weights. Adding or removing lead shot or inserting and extracting slug-weights in a deformed or tight pocket are extremely limiting factors of these prior devices.

SUMMARY OF THE INVENTION

A principle object of the present invention is to provide an accessory device that can be worn by a person so that the person can use the accessory device without holding it in the hands.

Another object is to provide an accessory device that can be attached to various types of apparel or other objects.

An additional object is to provide an accessory when attached to said apparel weight device that can easily be exchangeably varied in weight and size to fit an individuals own requirements and comfort level, and provide selective weight balance around the periphery of the garment.

A further object is to provide an accessory weight device that can be used about different areas of the body and extremeties.

A still further object is to provide an accessory device that is releasable and attachable to various types of apparel and other objects, and is relatively inexpensive, simple in construction and trouble free and reliable when in use.

Yet a still further object is to provide an article garment weight device which may be manufactured from materials that stretch and are flexible so that said garment weight device will comfortably fit the complete contours of the body parts they are worn on. The said garment may be manufactured from materials which will allow air exchange between the garment and the body. Stretch characteristics and contour adhesion inherent in said stretch characteristic will allow garment weight device to be worn with the invention positioned on upper or lower portions of arms and legs and will resist shifting and slipping of the weights and devices during exercise and therapy movements.

Even a further object is to provide weight configurations of various shapes and sizes so as to reduce the bulk of the weight systems and allow extreme flexibility of movement, while providing a simple and efficient means of adding or removing weights, while the garment weight device is being worn, during exercise or therapy. The weights may be manufactured in the shapes of commercial figures, such as cartoon characters and sports heros, or even trade mark symbols to help promote exercise among groups of all ages and interests. Because there are no shape and size limiting pockets or receptacles on the weight device, individual weights may also be manufactured in various shapes and sizes and may be rigid materials or flexible, bendable materials so they may even better conform to body contours and positions.

Further objects of the invention will appear as the description proceeds. To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows:

FIG. 1 is a side view showing the invention incorporated on a head band which may be a continuous closed type or open band adjustable type.

FIG. 2 is a side view showing the invention incorporated on a head gear.

FIG. 3 is a perspective view showing the invention on arm bands. Arm Bands may be the continuous closed type or open band adjustable type.

FIG. 4 is a side view showing the invention attached to a leg band. Leg band may be a continuous closed type or open band adjustable type.

FIG. 5 is a perspective view showing invention incorporated on a waist belt. Belt may be a continuous closed type or open adjustable type.

FIG. 6 is a perspective view of a belt, taken on line 6—6 of FIG. 5, with the invention attached thereon. In this FIG. 6, the invention consists of a weight with at least one strap permanently attached thereon with hook and loop fasteners attached to one or more sides of said strap.

FIG. 7 is an exploded view of a clip which fits over a headband with the weight attaching to said clip.

FIG. 8 is a perspective view, taken on line 8—8 of FIG. 1, of a headband with the invention attached thereon. In this FIG. 8, the invention consists of a weight with at least one separate strap attached thereto, holding the weight securely to the headband, with hook and loop fasteners attached to one or more sides of the strap.

DESCRIPTION OF THE PREFERRED EMBODIMENT

Turning now descriptively to the drawings, in which similar reference characters denote similar elements throughout the several views, FIG. 3 illustrates an accessory device that consists of a garment weight device 3 to be worn by a person with at least one weight device accessory 8 to be attached to garment weight device 3 and a fastener 7 for attaching the weight device accessory 8 to the garment weight device 3. The garment weight device 3 is an arm band used as an article of dress. The accessory 8 is a weight. The fastener 7 is a hook and loop type made of synthetic materials which adhere when pressed together.

In FIGS. 1, 7, and 8 the garment weight device 1 is a headband, while in FIG. 2 the garment 2 is a headgear that is placed on the head.

In FIG. 3 the garment weight device 3 is a arm band and garment weight device 11 is a hand band and in FIG. 4 the garment weight device 4 is a leg band.

FIG. 5 shows a belt weight device 5 to be worn about the waist by a person with at least one weight accessory 8 to be attached to belt 5 and at least one fastener 7 for attaching said weight accessory 8. FIG. 5 also shows at least one weight accessory 8 attached to belt 5 by use of a strap 10 with hook and loop fastener 7 attached to one or more sides of said strap. In addition FIG. 5 shows at least one weight 8 attaching to another weight 8 using fastener 7.

FIG. 6 shows weight accessory 8 with permanently attached strap 10 affixed to belt 5 by use of said strap 10 wrapped securely around belt 5 and then fastened to weight 8 by use of hook and loop fastener 7.

FIG. 7 shows a clip 6, one or more of which may be fitted over garments 1,2,3,4,5 and 11. The weight 8 is attached to said clip 6 by use of fastener 7. Accessory clip 6 may be manufactured with the weight 8 permanently affixed to the clip 6 as a one piece assembly.

FIG. 8 shows weight 8 attached to a head band 1 by use of a separate strap 9 wrapped securely around head band 1 with strap 9 attached to weight 8 by fastener 7 and then one end of strap 9 securely attached to the other end of strap 9 by fastener 7. FIG. 8 also shows at least one weight 8 attaching to another weight 8 through the intermediary fasteners 7 on one or more sides of strap 9.

FIG. 3 shows an arm band 3 with at least one or more openings in it, which allows it to be used as a hand band 11 with the thumb of the hand protruding through said opening. A hand band with finger receptacles or a closed end, glove and mitten style, with fastener 7 attached to said band serves the same purpose as hand band 11.

The fastener 7 throughout are the hook and loop type. FIGS. 1,2, and 7 show at least one clip 6 attached to the garment and at least one accessory weight 8 attached to said clip.

FIGS. 1,2,3,4,5,6,7 and 8 show a weight accessory 8, at least one or more of which can be attached to items 1,2,3,4,5, 6,9,10 and 11 using fastener 7.

FIG. 8 shows fastener 7 may be attached to one or more sides of weight accessory 8. One object of this construction of hook and loop material 7 on more than one side of weight accessory 8 allows weight accessories 8's to be attached to each other.

In operative use the weight accessory 8 may be manufactured naturally out of any suitable material and in any suitable shapes and sizes.

While certain novel features of this invention have been shown and described and are pointed out in the annexed claims, it will be understood that various omissions, substitutions and changes in the forms and details of the device illustrated and and in its operation can be made by those skilled in the art without departing from the spirit of the invention.

What is claimed is:

1. A weight device comprising, in combination, at least one weight element of sufficient weight for use in aerobic exercise and having top and bottom surfaces, with a hook or loop fastener material on the top of the weight element and a hook or loop fastener material on the bottom, and at least one strap having a hook or loop fastener material on both sides thereof, for wrapping the strap about the weight element and depending the weight from the body of a user.

2. The weight device as claimed in claim 1 wherein the strap is formed of a stretch type material.

3. The weight device as claimed in claim 1 including a belt to be worn about the body of a user, where the strap can be wrapped about the belt for attaching the weight device to the use.

4. The weight device as claimed in claim 3 including a clip fitting over the belt, the clip having hook or loop fastening material attached thereto for attaching the weight element to the clip.

5. The weight device as claimed in claim 1 including a headband to be worn about the head of a user, where the strap can be wrapped about the headband for attaching the weight to the head of the user.

6. The weight device as claimed in claim 5 including a clip fitting over the headband, the clip having hook or loop fastening material attached thereto for attaching the weight element to the clip.

* * * * *